US009437177B2

(12) United States Patent
Chiappe

(10) Patent No.: US 9,437,177 B2
(45) Date of Patent: Sep. 6, 2016

(54) PERCUSSION PRACTICE DRUM PAD

(71) Applicant: Richard Scott Chiappe, Granbury, TX (US)

(72) Inventor: Richard Scott Chiappe, Granbury, TX (US)

( * ) Notice: Subject to any disclaimer, the term of this patent is extended or adjusted under 35 U.S.C. 154(b) by 253 days.

(21) Appl. No.: 14/308,988

(22) Filed: Jun. 19, 2014

(65) Prior Publication Data

US 2015/0371617 A1 Dec. 24, 2015

Related U.S. Application Data

(60) Provisional application No. 61/836,989, filed on Jun. 19, 2013.

(51) Int. Cl.
*G10D 13/02* (2006.01)

(52) U.S. Cl.
CPC ..... *G10D 13/029* (2013.01)

(58) Field of Classification Search
USPC ..... 84/411 P
See application file for complete search history.

(56) References Cited

U.S. PATENT DOCUMENTS

| | | | | | |
|---|---|---|---|---|---|
| 2,475,873 | A * | 7/1949 | Banta | G10D 13/029 | 84/411 R |
| 3,166,970 | A * | 1/1965 | Ellman | G10D 13/029 | 84/411 R |
| 3,264,926 | A * | 8/1966 | Belli | G10D 13/029 | 84/411 R |
| 4,254,685 | A * | 3/1981 | Rose | G10D 13/027 | 84/411 R |
| 6,284,959 | B1 * | 9/2001 | Nicolosi | G10D 13/029 | 84/411 P |
| 6,362,407 | B1 * | 3/2002 | Dennis | G10D 13/08 | 84/411 M |
| D464,987 | S * | 10/2002 | Edwards | D17/22 | |
| 6,686,526 | B2 * | 2/2004 | Ezbicki | G09B 15/06 | 84/411 R |
| 7,723,593 | B1 * | 5/2010 | Prentice | G10D 13/029 | 84/411 P |
| 7,816,597 | B2 * | 10/2010 | Okada | G10D 13/024 | 84/411 R |
| 2008/0127803 | A1 * | 6/2008 | Liu | G10D 13/024 | 84/411 R |

* cited by examiner

*Primary Examiner* — Christopher Uhlir

(57) ABSTRACT

A percussion practice drum pad which is manufactured by pouring set-in-place polymers into one or more pockets in a rigid frame. Numerous unique defined features of the frame enable the device, when struck with a drumstick, to more closely simulate both the physical and aural characteristics of playing an actual acoustic drum; one or more secondary striking surfaces; and additional features that improve portability and mounting flexibility of the device.

9 Claims, 9 Drawing Sheets

PERCUSSION PRACTICE DRUM PAD

CONTINUING DATA

This application is a continuation of U.S. Patent Application No. 61/836,989 filed Jun. 19, 2013.

BACKGROUND

1. Field of the Invention

This invention relates to a device and methods for practicing drumming (percussion). In particular, the device and methods hereof faithfully replicate the physical and aural characteristics of playing an acoustic snare drum while providing features to make the device more portable and therefore more favorable for practicing drumming than using an actual acoustic drum.

2. Description of Related Art

Percussion practice drum pads exist in numerous iterations by numerous manufacturers. Percussion practice drum pads offer more portability, comfort, convenience and generate lower sound levels when practicing drumming as compared to playing an actual acoustic drum.

Various methods are utilized to offer percussionists a practice drum pad they can strike with drumsticks to develop technique and practice drumming in lieu of using an actual acoustic drum. One method is to affix a solid polymer such as rubber to a flat, hard surface such as wood. The wood provides a rigid foundation for the polymer pad and the polymer provides a "bouncing" effect when struck by a drumstick to allow percussionists to practice the physical motion of striking an actual acoustic drum.

Unlike such a polymer-on-foundation percussion practice drum pad however, an actual acoustic drum is comprised of a semi-flexible plastic "head" or "skin" that is stretched taught across a rigid cylindrical drum shell. As such, the physical and aural characteristics of striking an actual acoustic drum with a drum stick differ significantly from the physical and aural characteristics of striking a commercially available polymer-on-foundation percussion practice drum pad with a drum stick. For example, when struck with a drum stick, an actual acoustic drum head will physically reflex more when struck in the center of the drum head than it will when the drum head is struck near the edge or "rim" of the drum. Similarly, when struck with a drum stick, an actual acoustic drum head will produce more aural feedback or "volume" when struck in the center of the drum head than it will when the drum head is struck near the edge or "rim" of the drum. However, when struck with a drum stick, most commercially available percussion practice drum pads do not allow a drummer to distinguish either physically or aurally between a strike in the center of the percussion practice drum pad and one closer to the edge.

Considering the geometry of a typical fourteen inch diameter snare drum, when striking the center of the drum, the drum head flexes the most allowing the drumstick tip to deflect the head more than when the drum is struck nearer the edge of the drum where the head flexes quite a bit less. The result of the variation in drum head reflexivity is both physical; the drum stick physically rebounds more when striking the center of a drum than when striking nearer the edge, as well as aural; the drum provides a different sound to the player when struck in the center of the head versus when being struck nearer the edge. Few commercially available percussion practice drum pads for such variation in physical reflexivity when striking the center of the pad versus striking nearer the edge of the pad.

Commercially available percussion practice drum pads are available in numerous shapes and sizes. Those that are full sized or minimally scaled down often provide a favorable amount of strikable surface, can be mounted in a typical three-point "basket"-style snare drum stand and many provide a plastic "rim" that simulate the same characteristics of an actual acoustic drum. Due to their size, however, such devices are often more difficult to transport and do not fit easily in typical drum stick bags or cases. Those pads that are scaled down significantly are more easy to transport or store in a typical drum stick bag or case, but fail to provide the other authentic playing characteristics of an actual acoustic drum such as a strikable "rim" or the ability to mount the pad in a typical three-point "basket"-style snare drum stand.

SUMMARY OF INVENTION

A percussion practice drum pad comprised of a keyhole-shaped primary striking surface wherein the material of which varies in thickness to produce a more realistic aural and physical drumming response; a secondary striking surface comprised of a thick, soft material that provides an endurance or drumming workout response; and aluminum frame that provides a simulated drum rim to enable authentic "rim shot" response; and a set of articulation "wings" that enable the device to be stored compactly or mounted easily in a typical 3-point backet-style snare drum stand for playing.

DETAILED DESCRIPTION

Generally speaking, the system and methods of the present invention rectifies each of the aforementioned shortcomings of current commercially available percussion practice drum pads as follows.

The invention incorporates notable features that enable the device to more faithfully replicate the physical and aural feedback produced when striking an actual acoustic drum with a drumstick. These features provide both physical and aural feedback to the user that more closely approximates the physical and aural feedback of striking an actual acoustic drum. The invention also incorporates features that enable the device to be used on any flat, hard surface, such as a desk, as well as the player's lap, securely placed on top of an acoustic drum as shown in FIG. 2, as well as mounted in a typical three-point "basket"-style snare drum stand as shown in FIG. 3.

As shown in FIG. 1, the invention 1 is comprised of a frame 2, keyhole-shaped, polymer-filled primary striking surface 3, polymer-filled secondary striking surface 4, articulating wings 5, and underside rubber pad 6.

The frame 2 is manufactured from any hard, rigid and/or structural material such as aluminum, that is capable of faithfully providing notable features. Other materials could be used to form the frame 2 including medium density fiberboard, wood, plastic, composite or other metal alloys.

The primary striking surface 3 is manufactured by pouring a cured-in-place liquid polymer into the keyhole-shaped pocket 2*a* geometric feature of the frame 2.

The polymer used to create the primary striking surface 3 is of a consistency, density and hardness to best approximate the physical rebound characteristics of an actual acoustic drum. Such a polymer would be a durable compound such as industrial urethane that provides a hardness or "durometer" of 60 to 90 "Shore Durometer."

Besides its keyhole perimeter shape 2*a,* the geometry of the frame 2 also provides the following notable features to create the primary striking surface 3: geometry of the concave floor pan 2*b,* vibration isolation channels 2*c,* hinges 2*d,* spring 2*e,* and rim 2*f.*

Because the geometry of the concave floor pan 2*b* below the primary striking surface 3 is concave, the polymer that is set-in-place in the keyhole-shaped pocket 2*a* is thicker in the center of the device and thinner as the striking surface nears the edge of the device. Because of this, when struck with a drumstick the polymer rebounds the stick more when struck in the thicker center area of the primary striking surface 3 and rebounds the stick less when struck increasingly nearer the edge of the primary striking surface 3. It is this feature which allows the device to more faithfully produce physical and aural feedback characteristics of striking an actual acoustic drum.

The concave floor pan 2*b* below the primary striking surface 3 is isolated from the frame by three narrow, isolation channels 2*c* that cut completely through the frame material as shown in FIG. 6. These three narrow, cut isolation channels 2*c* prevent vibrations generated by striking the primary striking surface 3 from reaching the rigid frame 2 and rebounding unfavorably back into the primary striking surface 3 so as to provide the user a more pleasant playing experience free of undesirable vibration.

In three locations shown in FIG. 7, the isolation channels 6, converge near each other in three places leaving a narrow amount of frame material in these three places below the primary striking surface 3. In two corners, these features create hinges 2*d* and at the center the convergence of two of the narrow isolation channels 2*c* form a spring 2*e*. These three features enable the concave floor pan 2*b* below the primary striking surface 3 to "swing" a fractional distance allowing the device to closely simulate the rebound effect of striking an actual acoustic drum. Again, striking the primary striking surface 3 in the center allows for more deflection of the primary striking surface 3 than does striking the primary striking surface 3 nearer the edge of the device.

The previously described features noted in FIGS. 6 and 7, the concave geometry of the concave floor pan 2*b* beneath the primary striking surface 3 in FIGS. 4 and 5 and the rebound characteristics of the polymer used in the primary striking surface 3 all combine to provide desirable physical and aural feedback characteristics of the device when striking the primary striking surface with a drumstick.

The geometry of the frame 2 also offers a second pocket that when filled with a polymer provides the user a secondary striking surface 4. By filling this second pocket in the frame 2 with a liquid cured-in-place polymer such as silicone with softer Shore durometer of 10 to 30, the secondary striking surface 4 provides a user a different degree of reflexivity to a drumstick striking the secondary striking surface 4 than when a drumstick strikes the primary striking surface 3. Users of the device will find striking the secondary striking surface 4 with drumsticks is desirable for quieter aural feedback or more difficult physical playing characteristics such as when exercising or warming-up their hand and arm muscles while practicing drumming.

The geometry of the frame 2 features a continuous rigid raised rim 2*f* along the entire perimeter of the frame 2. The rim 2*f* provides a user the ability to simultaneously strike the primary striking surface 3 with the tip of a drumstick and the rim 2*f* with the shoulder of a drumstick so as to permit the playing of "rim shots." Rim shots are a drumming rudiment common in most snare drum musical literature for the playing of snare drum and an important component of authentically simulating the playing characteristics of an actual acoustic drum with a percussion practice drum pad. The height of the rim 2*f* relative to the top of the primary striking surface 3 is manufactured such that the stick angle at which the user hits "rim shots" is the same as it would be when playing an actual 14" diameter acoustic snare drum.

Another notable feature of the device are the two articulating wings 5. When the device is stored, transported, or used on any flat surface, the user pushes the articulating wings 5 into the retracted position such as in FIG. 2. To mount the device in a typical three-point "basket"-style snare drum stand 8, the user pulls on each of the two articulating wings 5 into the extended position allowing the device to be mounted typical three-point "basket"-style snare drum stand 8 as shown in FIG. 3.

The underside of the device features a rubber pad 6 which allows the device to be used on any flat surface without damaging that surface. The underside rubber pad 6 also provides friction to prevent lateral movement of the device when used on any smooth, flat surface.

BRIEF DESCRIPTION OF THE DRAWINGS

FIG. 4*a* shows the primary hittable surfaces 9 of a typical 14" diameter snare drum 10. FIG. 4*b* shows the invention 1 overlaid on the 14" diameter same snare drum 10 to demonstrate how the key-hole shaped primary striking surface 3 is shaped identical to the hittable surfaces 9 of a 14" diameter snare drum 10.

Figure 1:
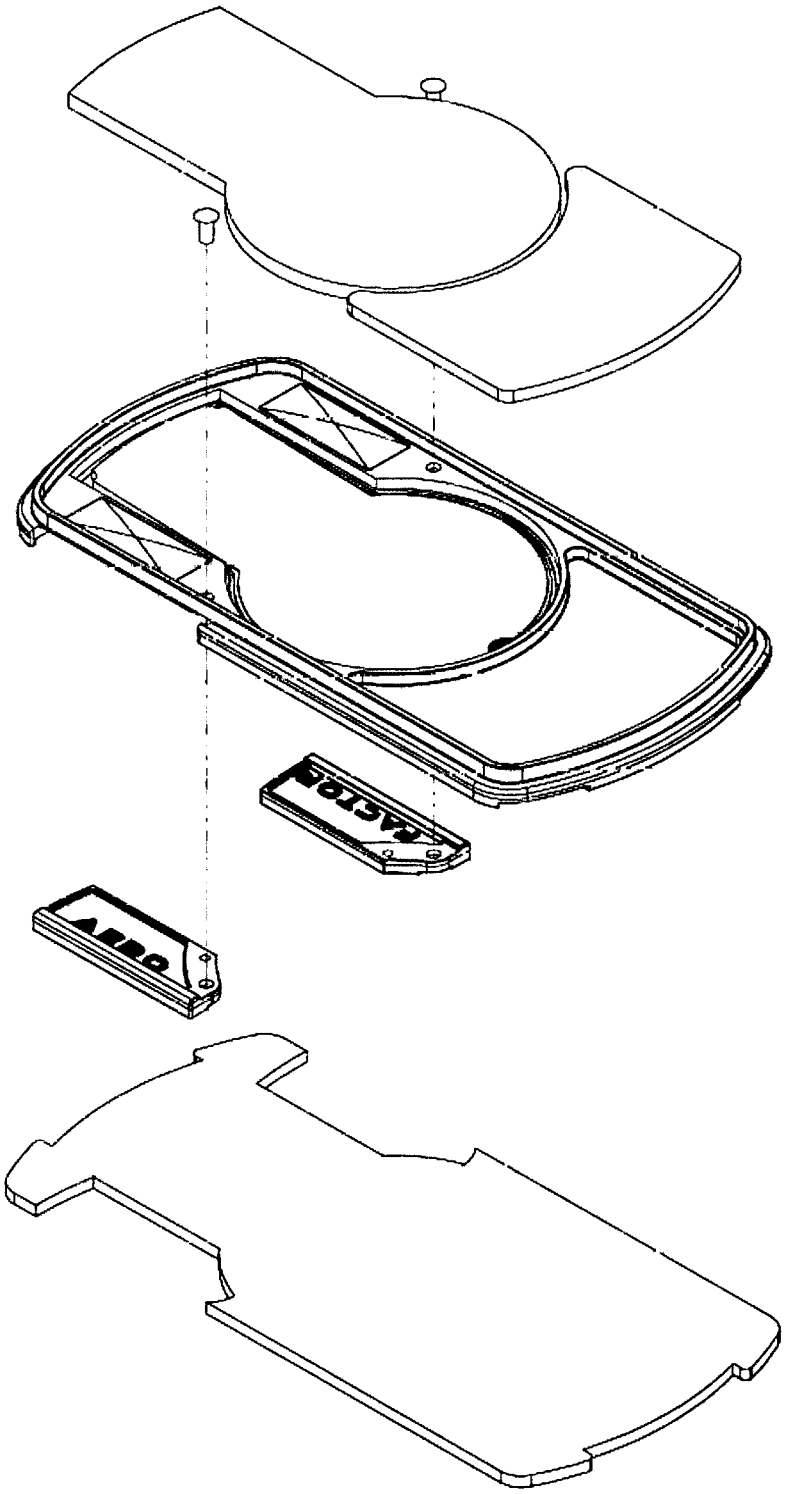
FIG. 1 is an isometric view of the invention 1 with its components exploded for the purpose of detailing the components of the invention: frame 2, primary striking surface 3, secondary striking surface 4, articulating wings 5, and underside padding 6.
Figure 2:
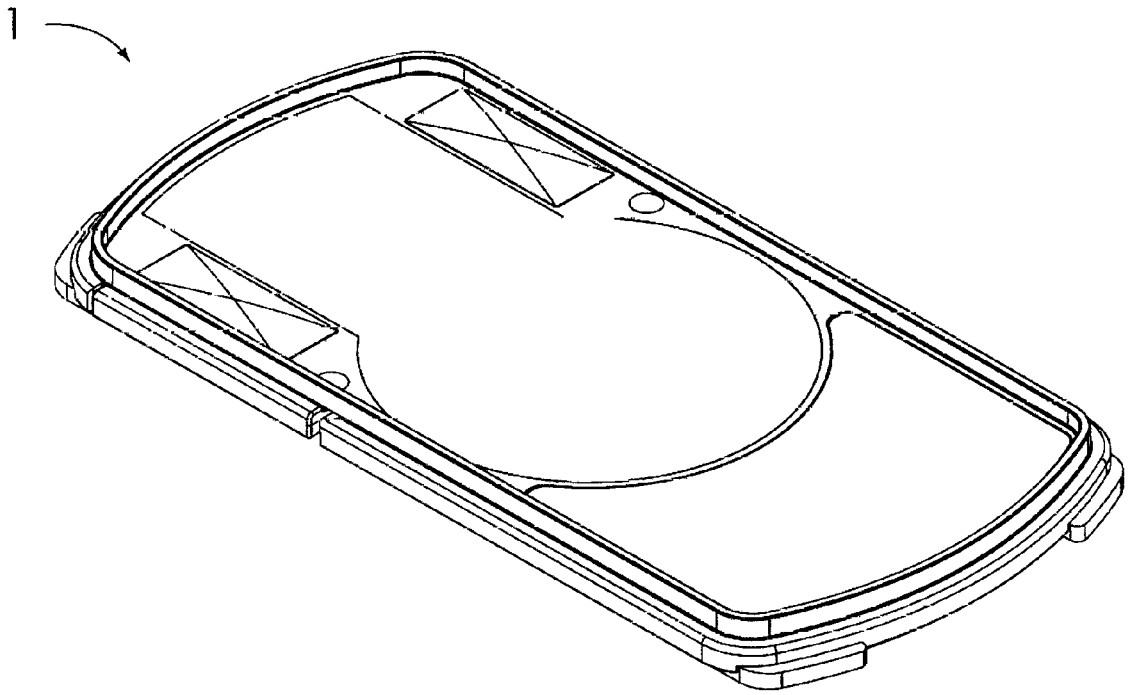
FIG. 2 is an isometric view of the invention 1 configured to be used on a flat surface such as a table, desktop or top of a drum or to be stored in a drum stick bag, case or backpack.
Figure 3:
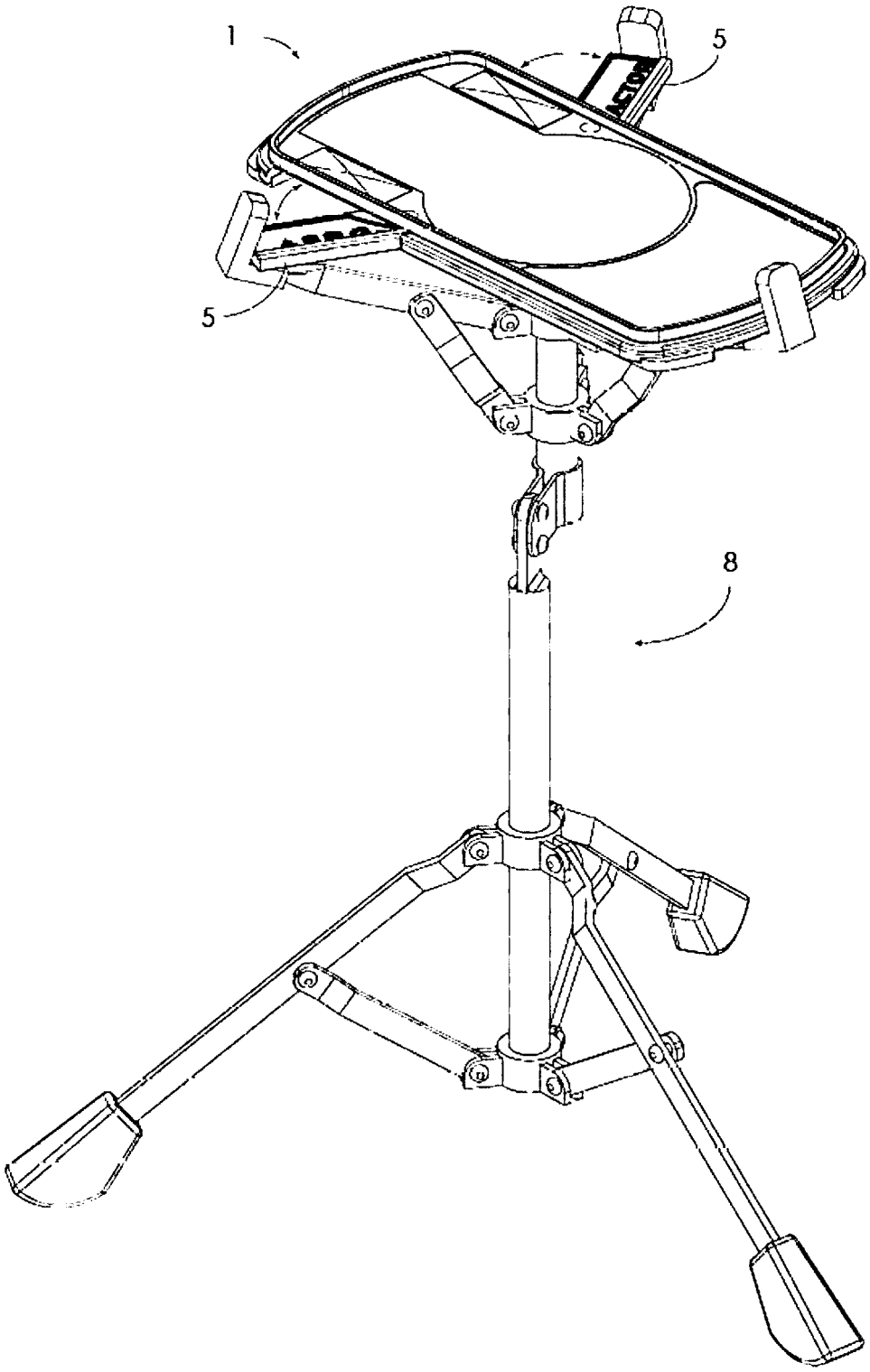
FIG. 3 is an isometric view of the invention 1 configured with the articulating wings 5 extended mounted in a standard three-point "basket"-type snare drum stand 8.
Figure 4A:
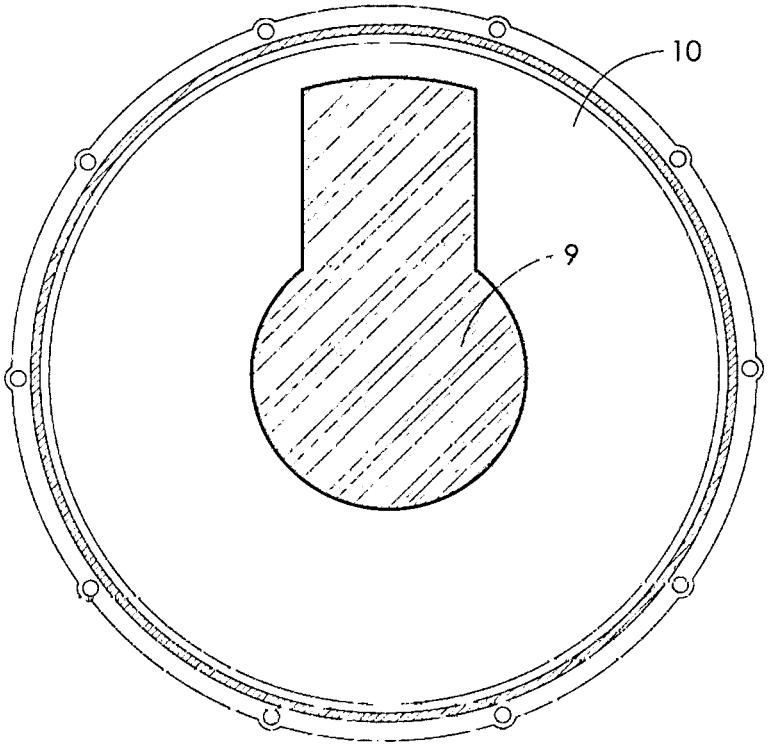
FIG. 4*a* and FIG. 4*b* are comprised of two plan views of a 14" diameter snare drum 10.
Figure 4B:
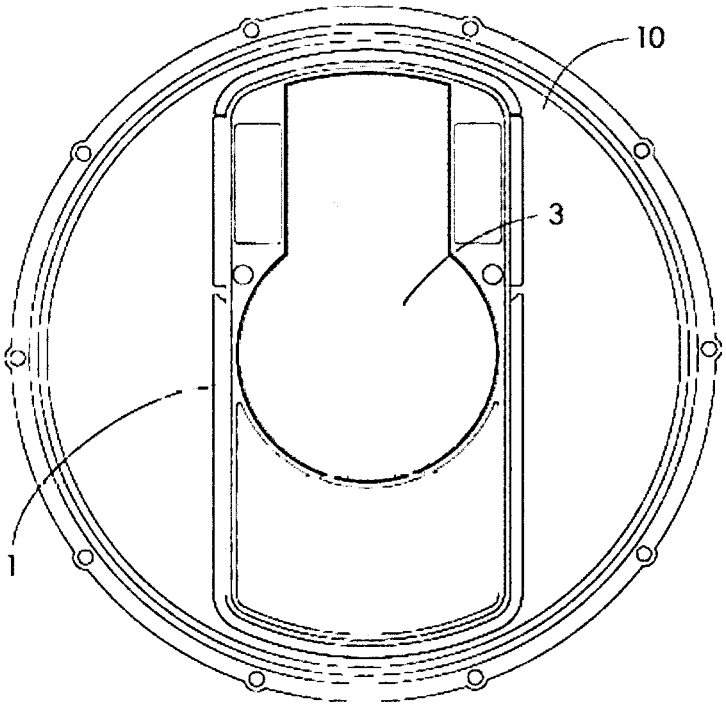
Figure 5:
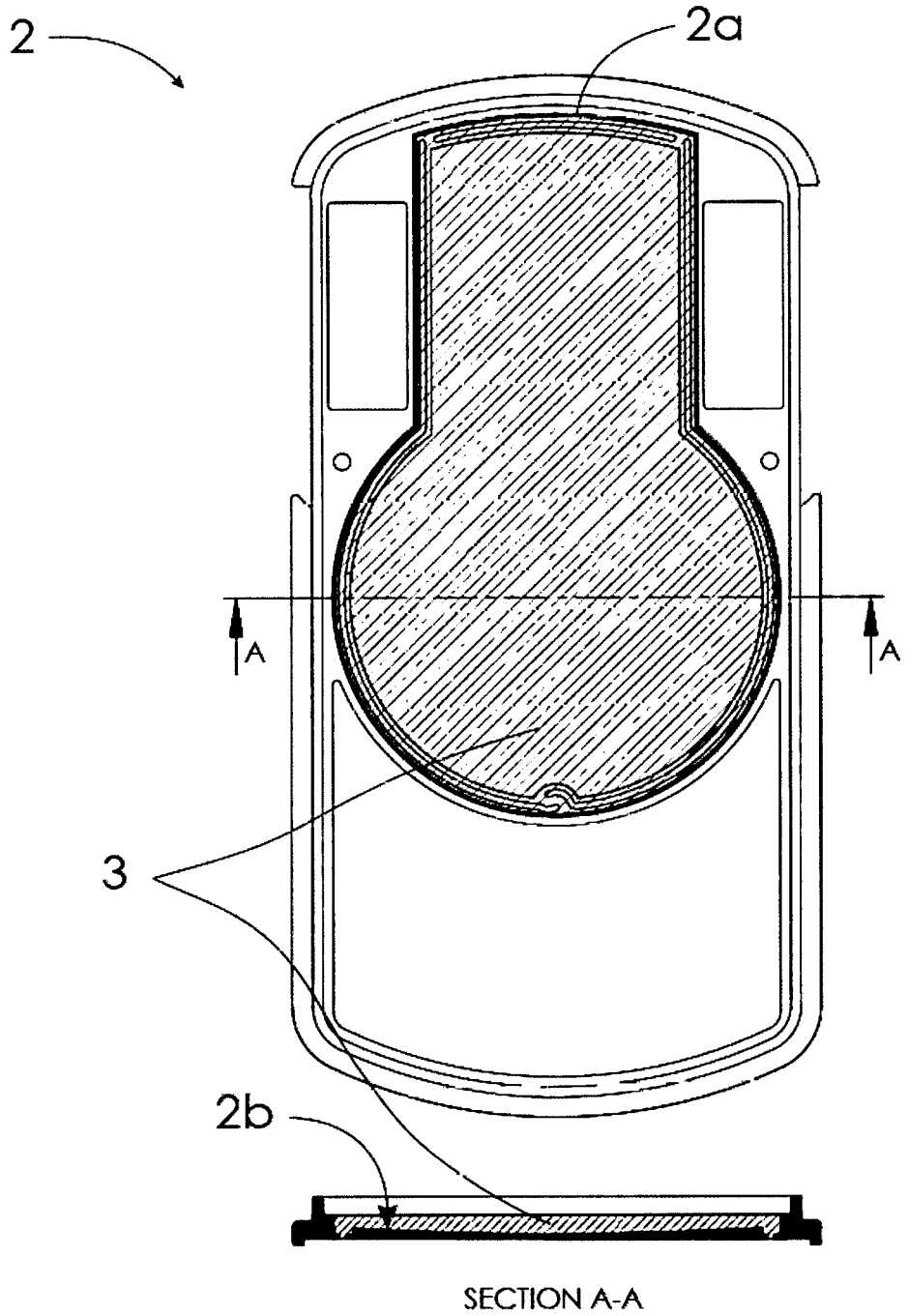
FIG. 5 is a plan view of the frame 2 highlighting the keyhole shaped pocket 2*a* of the primary striking surface 3 and a side view detail of section A-A highlighting the geometry of the concave floor pan 2*b* below the primary striking surface 3.
Figure 6:
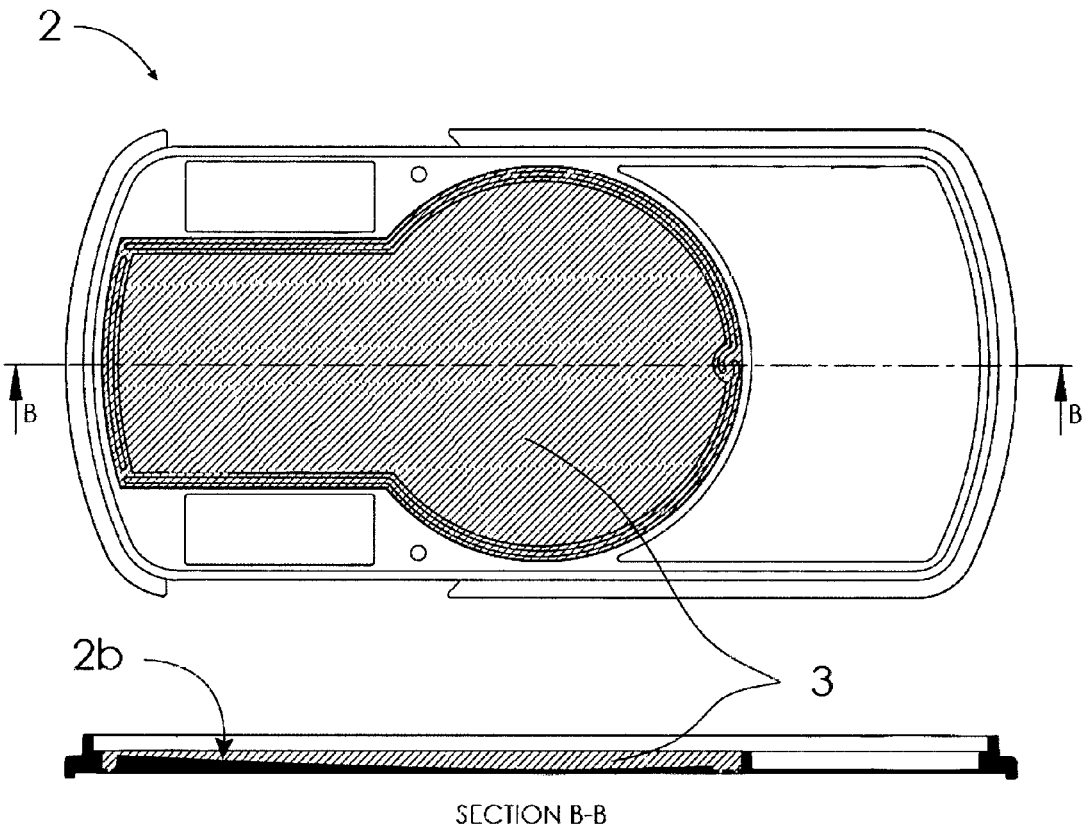
FIG. 6 is a plan view of the frame 2 and a side view detail of section B-B highlighting the geometry of the concave floor pan 2*b* below the primary striking surface 3.
Figure 7:
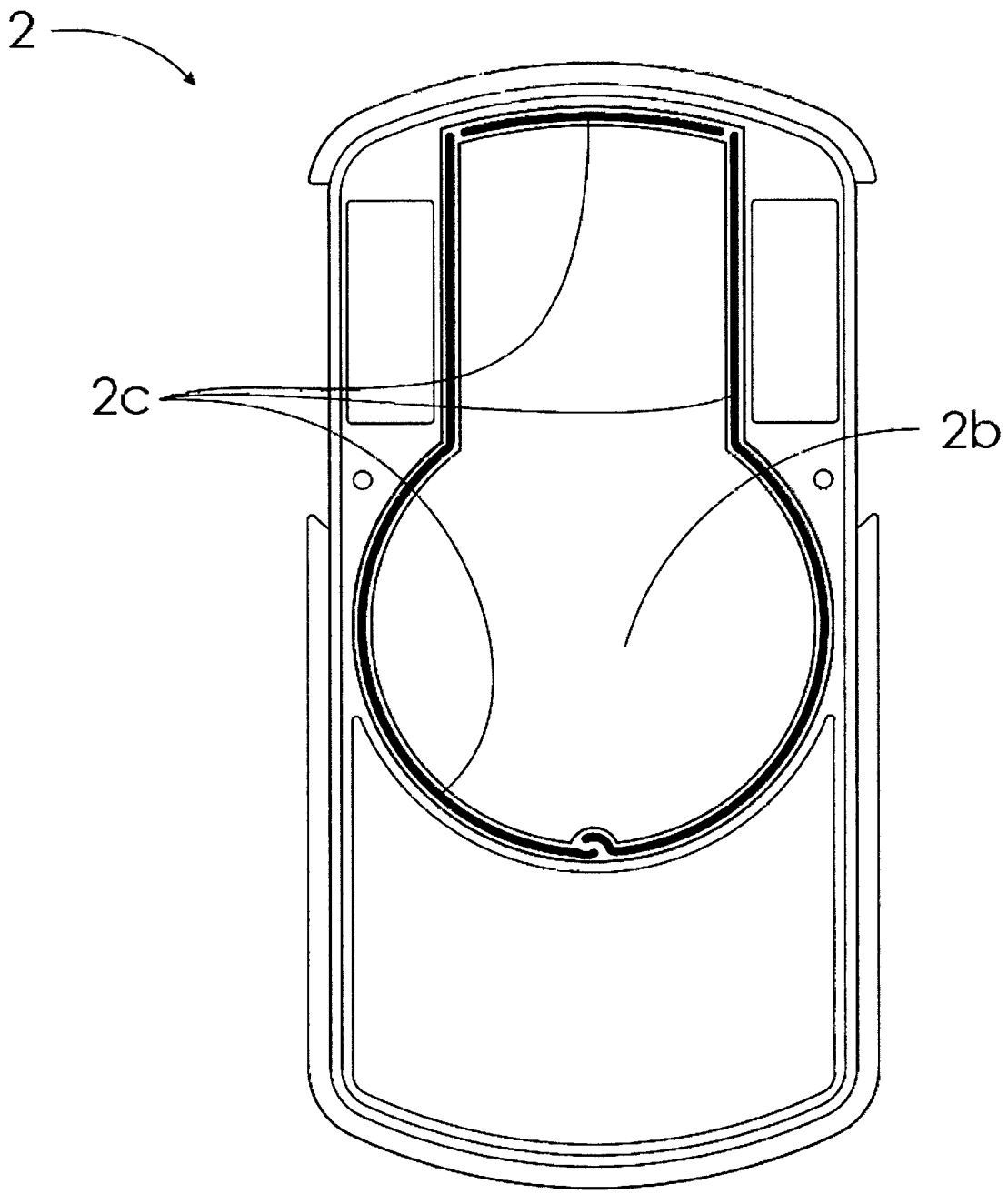
FIG. 7 is plan view of the frame 2 highlighting the isolation channels 2*c* separating the concave floor pan 2*b* below the primary striking surface 3 from the frame 2.
Figure 8:
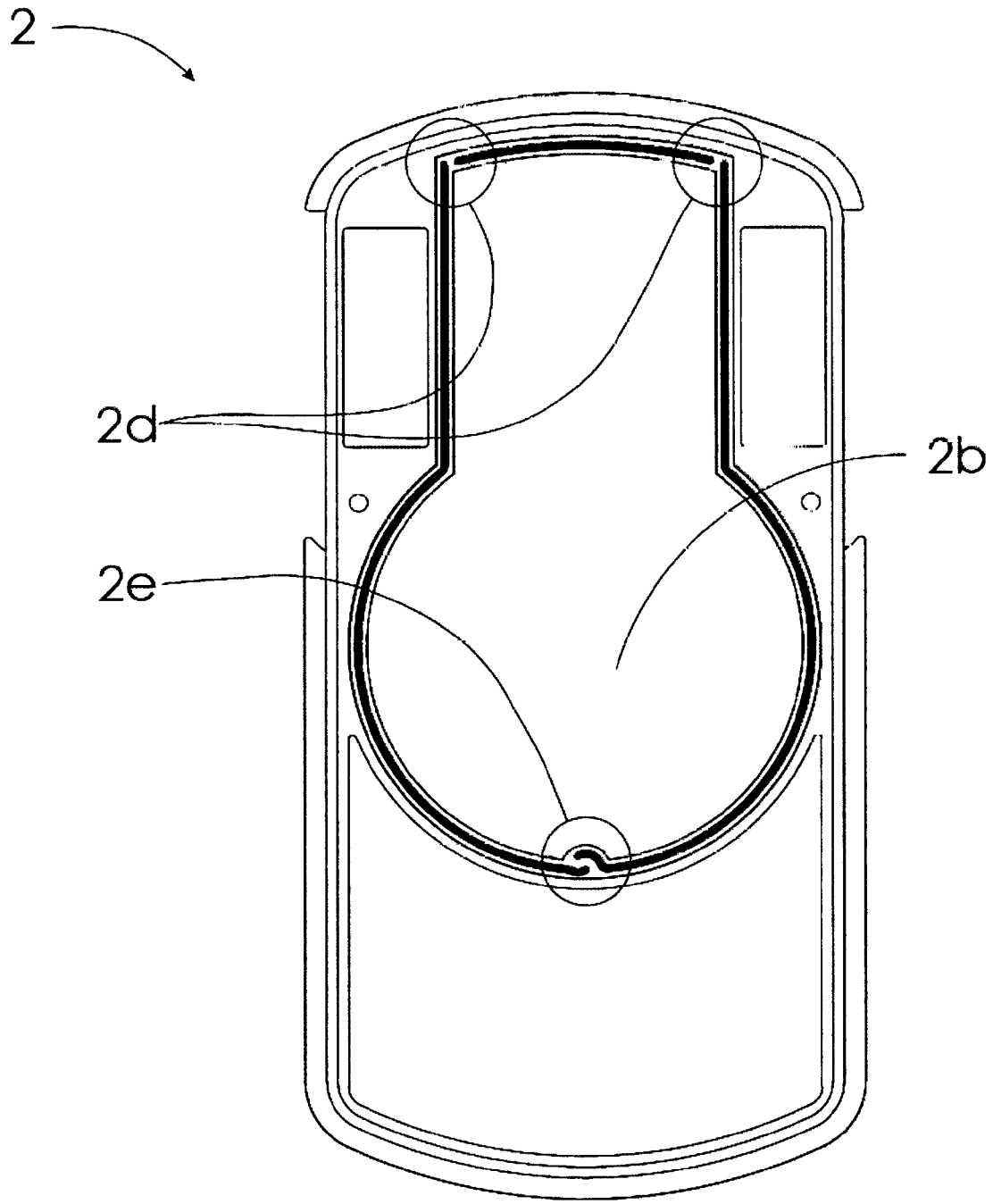
FIG. 8 is plan view of the frame 2 highlighting hinges 2*d* and spring 2*e* features of the concave floor pan 2*a* below the primary striking surface 3 from the frame 2.
Figure 9:
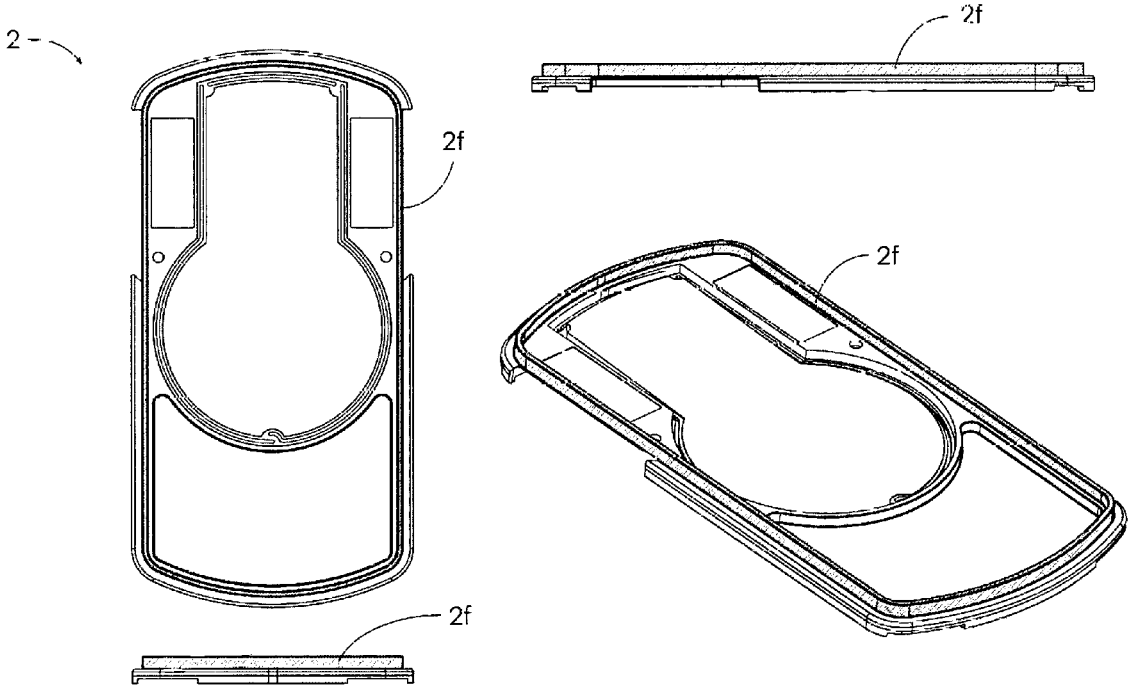
FIG. 9 is a four-view set of isometric drawings of the frame 2 with hashes highlighting the elevated perimeter rim 2*f* feature of the frame 2.

What is claimed:

1. A percussion practice drum pad, comprising:

a keyhole-shaped primary striking surface having a circular portion and a substantially rectangular extension portion extending laterally from the circular portion;

a floor pan underlying the primary striking surface, wherein the thickness of the pan varies underneath the primary striking surface and the thickness of the primary striking surface overlying the floor pan varies substantially inverse to the thickness of the floor pan, a secondary striking surface adjacent the primary striking surface and comprising a material softer than the material of the primary striking surface; and a frame having a raised rim portion along its perimeter.

2. The percussion practice drum pad of claim 1, wherein the thickness of the primary striking surface is greatest in a central area of the circular portion and least in the extension portion.

3. The percussion practice drum pad of claim 1, wherein the extension portion adjoins and extends radially outward from the circular portion.

4. The percussion practice drum pad of claim 1, wherein the floor pan has a plurality of grooves circumferentially isolating the floor pan from a practice drum pad frame.

5. The percussion practice drum pad of claim 1, wherein the floor pan is connected to the pad frame by a plurality of bridges.

6. The percussion practice drum pad of claim 1, wherein the primary surface comprises a polymer material with approximately a 70-90 Shore A hardness, and said secondary striking surface comprises a polymer material with approximately a 5-40 Shore A hardness.

7. The percussion practice drum pad of claim 1, wherein the practice drum pad frame has a plurality of wings that may be extended from the frame for operatively engaging a stand.

8. The percussion practice drum pad of claim 1, wherein the practice drum pad frame has a raised rim that extends upward from the frame so as to be more elevated than the primary striking surface.

9. A percussion practice drum pad, comprising:

a keyhole-shaped primary striking surface having a circular portion and rectangular extension outwardly extending from the circular portion;

wherein the thickness of the primary striking surface is greatest in the center of the circular portion and least in the rectangular extension;

a secondary striking surface adjacent the primary striking surface and comprising a harder material; and a floor pan underlying the primary striking surface, being substantially isolated from a practice drum pad frame, and having a plurality of bridges coupling the floor pan to the frame.

* * * * *